US007860708B2

(12) United States Patent
Kim

(10) Patent No.: US 7,860,708 B2
(45) Date of Patent: Dec. 28, 2010

(54) APPARATUS AND METHOD FOR EXTRACTING PITCH INFORMATION FROM SPEECH SIGNAL

(75) Inventor: Hyun-Soo Kim, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 930 days.

(21) Appl. No.: 11/786,213

(22) Filed: Apr. 11, 2007

(65) Prior Publication Data

US 2007/0239437 A1 Oct. 11, 2007

(30) Foreign Application Priority Data

Apr. 11, 2006 (KR) ..... 10-2006-0032824

(51) Int. Cl.
*G10L 11/04* (2006.01)

(52) U.S. Cl. ..... 704/207; 704/205; 704/226

(58) Field of Classification Search ..... 704/205, 704/206, 207, 208, 226, 227
See application file for complete search history.

(56) References Cited

U.S. PATENT DOCUMENTS

| | | | | |
|---|---|---|---|---|
| 4,731,846 | A * | 3/1988 | Secrest et al. | 704/207 |
| 5,189,701 | A * | 2/1993 | Jain | 704/207 |
| 5,220,108 | A * | 6/1993 | Hashimoto et al. | 588/317 |
| 5,715,365 | A * | 2/1998 | Griffin et al. | 704/214 |
| 5,774,837 | A * | 6/1998 | Yeldener et al. | 704/208 |
| 5,930,747 | A * | 7/1999 | Iijima et al. | 704/207 |
| 5,999,897 | A * | 12/1999 | Yeldener | 704/207 |
| 6,047,253 | A | 4/2000 | Nishiguchi et al. | |
| 6,456,965 | B1 * | 9/2002 | Yeldener | 704/207 |
| 6,526,376 | B1 * | 2/2003 | Villette et al. | 704/207 |
| 6,587,816 | B1 * | 7/2003 | Chazan et al. | 704/207 |
| 6,662,153 | B2 | 12/2003 | Kim et al. | |
| 6,766,288 | B1 * | 7/2004 | Smith | 704/207 |
| 7,027,979 | B2 * | 4/2006 | Ramabadran | 704/205 |

(Continued)

FOREIGN PATENT DOCUMENTS

| | | |
|---|---|---|
| JP | 2001-177416 | 6/2001 |

(Continued)

OTHER PUBLICATIONS

L.R. Rabiner, "On The Use of Autocorrelation Analysis for Pitch Detection", IEEE Trans. Acoust., Speech, Sig. Process., ASSP-25, No. 1, pp. 24-33, Feb. 1977.

*Primary Examiner*—Martin Lerner
(74) *Attorney, Agent, or Firm*—The Farrell Law Firm, LLP

(57) ABSTRACT

An apparatus and method for extracting pitch information from a speech signal. The apparatus includes a pilot pitch detector for extracting predicted pitch information from a frame of an input speech signal, a pitch candidate value selector for selecting one or more pitch candidate values from the predicted pitch information according to a predetermined condition, a harmonic-noise region decomposer for decomposing a harmonic-noise region using each of the selected pitch candidate values, a harmonic-noise energy ratio calculator for calculating an energy ratio of each of the decomposed harmonic regions to each of the decomposed noise regions, and a pitch information selector for selecting a pitch candidate value of a harmonic-noise region in which the maximum value among the calculated harmonic-noise energy ratio exists as a pitch value of the input frame of the speech signal.

12 Claims, 4 Drawing Sheets

U.S. PATENT DOCUMENTS

| | | | | |
|---|---|---|---|---|
| 7,092,881 | B1 * | 8/2006 | Aguilar et al. | 704/233 |
| 7,171,357 | B2 * | 1/2007 | Boland | 704/231 |
| 7,191,128 | B2 | 3/2007 | Sall et al. | |
| 7,266,493 | B2 * | 9/2007 | Su et al. | 704/207 |
| 7,286,980 | B2 * | 10/2007 | Wang et al. | 704/205 |
| 7,493,254 | B2 * | 2/2009 | Jung et al. | 704/207 |
| 7,593,847 | B2 * | 9/2009 | Oh | 704/207 |
| 7,672,836 | B2 * | 3/2010 | Lee et al. | 704/207 |
| 2002/0111798 | A1 * | 8/2002 | Huang | 704/220 |
| 2003/0171917 | A1 * | 9/2003 | Zhu et al. | 704/207 |
| 2003/0204543 | A1 | 10/2003 | Yoon et al. | |
| 2004/0059570 | A1 | 3/2004 | Mochinaga et al. | |
| 2004/0133424 | A1 | 7/2004 | Ealey et al. | |
| 2005/0149321 | A1 * | 7/2005 | Kabi et al. | 704/207 |
| 2007/0010997 | A1 | 1/2007 | Kim | |
| 2007/0011001 | A1 * | 1/2007 | Kim | 704/219 |
| 2007/0027681 | A1 * | 2/2007 | Kim | 704/208 |
| 2007/0106503 | A1 | 5/2007 | Kim | |
| 2007/0299658 | A1 * | 12/2007 | Wang et al. | 704/207 |

FOREIGN PATENT DOCUMENTS

| | | |
|---|---|---|
| KR | 1019980024790 | 7/1998 |
| KR | 1020020022256 | 3/2002 |
| KR | 1020030070178 | 8/2003 |
| KR | 1020030085354 | 11/2003 |
| KR | 1020040026634 | 3/2004 |
| KR | 1020070007684 | 1/2007 |
| KR | 1020070007697 | 1/2007 |
| KR | 1020070015811 | 2/2007 |

* cited by examiner

APPARATUS AND METHOD FOR EXTRACTING PITCH INFORMATION FROM SPEECH SIGNAL

PRIORITY

This application claims priority under 35 U.S.C. §119 to an application entitled "Apparatus and Method for Extracting Pitch Information from Speech Signal" filed in the Korean Intellectual Property Office on Apr. 11, 2006 and assigned Serial No. 2006-32824, the contents of which are incorporated herein by reference.

BACKGROUND OF THE INVENTION

1. Field of the Invention

The present invention relates generally to an apparatus and method for processing a speech signal, and in particular, to an apparatus and method for extracting pitch information from a speech signal.

2. Description of the Related Art

In general, an audio signal including a speech signal and a sound signal is classified into a periodic or harmonic component and a non-periodic or random component, i.e., a voice part and an non-voice part, according to statistical characteristics in a time domain and a frequency domain and is called quasi-periodic. The periodic component and the non-periodic component are determined as the voice part and the unvoiced part according to the existence or non-existence of pitch information, and a periodic voice sound and a non-periodic non-voice sound are identified based on the pitch information. In particular, the periodic component has most information and significantly affects sound quality, and a period of the voice part is called a pitch. That is, pitch information is typically regarded as highly important information in systems which process speech signals, and a pitch error is an element which most significantly affects the general performance and sound quality of these systems.

Thus, how accurately the pitch information is detected is important for improving the sound quality. Conventional pitch information extraction methods are based on linear prediction analysis by which a signal of a post-stage is predicted using a signal of a pre-stage. In addition, because of its superior performance, a pitch information extraction method is widely used to represent a speech signal based on a sinusoidal representation and to calculate a maximum likelihood ratio using the harmonics of the speech signal.

In a Linear Prediction Analysis Method (LPAM) widely used for speech signal analysis, the performance of the method is affected according to the order of the linear prediction. Accordingly, if the order is increased to improve the performance, the number of calculations required to perform the LPAM also increases. Therefore, the performance of the prediction analysis method is limited by the number of calculations. The prediction analysis method works only when it is assumed that a signal is stationary for a short time. Thus, in a transition region of a speech signal, the linear prediction cannot easily follow the rapidly changed speech signal, resulting in a failure of the linear prediction analysis.

In addition, the linear prediction analysis method uses data windowing, and in this case, if the balance between resolutions of a time axis and a frequency axis is not maintained, it is difficult to detect a spectral envelope. For example, for voice having a very high pitch, the prediction follows individual harmonics rather than the spectral envelope because of wide gaps between the harmonics when the linear prediction analysis method is used. Thus, for a speaker with a high-pitched voice, such as a woman or a child, the performance of linear prediction analysis methods tends to decrease. Regardless of these problems, the linear prediction analysis method is a spectrum prediction method widely used because of a resolution in the frequency axis and an easy application in voice compression.

However, the conventional pitch information extraction methods may experience pitch doubling or pitch halving. In detail, to extract correct pitch information from a frame, the length of only a periodic component having pitch information in the frame must be found. However, conventional systems may incorrectly determine a period which is one-half or twice the length of the periodic component which is known as pitch doubling and pitch halving, respectively. As described above, since the conventional pitch information extraction methods may experience pitch doubling and/or pitch halving, a pitch error affecting the general performance and sound quality of a system must be considered.

When the pitch error is generated, a frequency considered as the best candidate is selected using an algorithm, and the pitch error is distinguished by a fine error ratio due to the performance limit of the algorithm and a gross error ratio indicating a ratio of the number of frames including errors to the number of total frames. For example, when errors are generated in 5 frames out of 100 frames, the fine error ratio is a difference between pitch information of the 95 frames and pitch information after a checking process, and an error range has a tendency to increase according to an increase of noise. The gross error ratio is obtained from an unrecoverable error of around one period in the pitch doubling and around half a period in the pitch halving.

As described above, the conventional pitch information extraction methods perform poorly with respect to the pitch error most significantly affecting the general performance and sound quality of a system due to the pitch doubling or halving.

SUMMARY OF THE INVENTION

To substantially solve at least the above problems and/or disadvantages and to provide at least the advantages below, the present invention provides an apparatus and method for extracting pitch information from a speech signal to improve an accuracy of pitch information extraction.

The present invention provides an apparatus and method for extracting pitch information from a speech signal using an energy ratio of a noise region of the speech signal to a harmonic region.

According to one aspect of the present invention, there is provided an apparatus for extracting pitch information from a speech signal, the apparatus including a pilot pitch detector for extracting predicted pitch information from a frame of an input speech signal; a pitch candidate value selector for selecting one or more pitch candidate values from the predicted pitch information according to a predetermined condition; a harmonic-noise region decomposer for decomposing a harmonic-noise region using each of the selected pitch candidate values; a harmonic-noise energy ratio calculator for calculating an energy ratio of each of the decomposed harmonic regions to each of the decomposed noise regions; and a pitch information selector for selecting a pitch candidate value of a harmonic-noise region in which the maximum value among the calculated harmonic-noise energy ratio exists as a pitch value of the input frame of the speech signal.

According to another aspect of the present invention, there is provided a method for extracting pitch information from a speech signal, the method including extracting predicted pitch information from a frame of an input speech signal; selecting one or more pitch candidate values from the predicted pitch information according to a predetermined condition; decomposing a harmonic-noise region using each of the selected pitch candidate values; calculating an energy ratio of each of the decomposed harmonic regions to each of the decomposed noise regions; and selecting a pitch candidate value of a harmonic-noise region in which the maximum value among the calculated harmonic-noise energy ratio exists as a pitch value of the input frame of the speech signal.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

Preferred embodiments of the present invention will be described herein below with reference to the accompanying drawings. In the following description, well-known functions or constructions are not described in detail since they would obscure the invention in unnecessary detail.

The present invention provides a method for improving the accuracy of extracting pitch information from a speech signal. The present invention extracts pitch information from a speech signal input to a pre-processing process of a speech processing system for performing voice coding, recognition, synthesis, and robustness and provides the extracted pitch information to the speech processing system in the post-stage.

Figure 1:
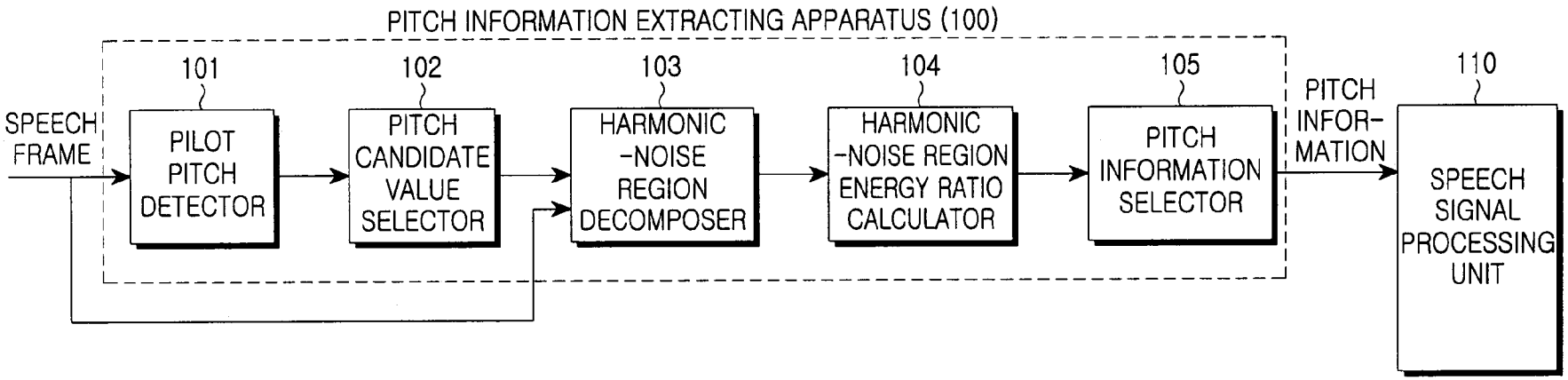
FIG. 1 is a block diagram of an apparatus for extracting pitch information from a speech signal according to the present invention.

FIG. 1 is a block diagram of an apparatus for extracting pitch information from a speech signal according to the present invention. Referring to FIG. 1, a pitch information extracting apparatus 100 includes a pilot pitch detector 101, a pitch candidate value selector 102, a harmonic-noise region decomposer 103, a harmonic-noise region energy ratio calculator 104, and a pitch information selector 105.

The pitch information extracting apparatus 100 receives a speech signal of a frequency domain converted from a speech signal of a time domain. In more detail, a speech signal input from a speech signal input unit (not shown), which can be include a microphone, is converted from the time domain to the frequency domain by a frequency domain converter (not shown). The frequency domain converter converts a speech signal of the time domain to a speech signal of the frequency domain using a fast Fourier transform (FFT).

The speech signal input to the pitch information extracting apparatus 100 is input to the pilot pitch detector 101.

The pilot pitch detector 101 extracts predicted pitch values from a frame of the input speech signal using a pitch detection algorithm. The detection of pitch values using the pitch detection algorithm is known in the art and is described by, for example, L. R. Rabiner, "On The Use Of Autocorrelation Analysis For Pitch Detection", IEEE Trans. Acoust., Speech, Sig. Process., ASSP-25, pp. 24-33, 1977 and A. M. Noll, "Pitch Determination Of Human Speech By The Harmonic Product Spectrum, The Harmonic Sum Spectrum, And A Maximum Likelihood Estimate", Proc. Symposium on Computer Processing in Communications, USA, vol. 14, pp. 779-797, April. 1969. Accordingly, for the sake of clarity, a further description will not be given.

The pitch candidate value selector 102 selects a pitch candidate value by selecting a predicted pitch value corresponding to a range pre-set to select a candidate value among pitch values predicted in the speech signal frame. The pre-set range can be determined according to the performance of a system. The pitch candidate value selector 102 outputs the selected pitch candidate value to the harmonic-noise region decomposer 103.

The harmonic-noise region decomposer 103 decomposes a harmonic-noise region by determining a harmonic segment using the selected pitch candidate value. Since N pitch candidate values can be used to decompose harmonic-noise regions, N harmonic-noise regions are decomposed using the N pitch candidate values. For example, if 5 pitch candidate values are used, 5 harmonic-noise regions can be decomposed using the 5 pitch candidate values.

A process of decomposing a harmonic-noise region using one of the pitch candidate values in the harmonic-noise region decomposer will now be described in more detail with reference to FIG. 2 which is a block diagram of a harmonic-noise region decomposer of FIG. 1.

If the speech signal converted to the frequency domain is input, a harmonic segment determiner 200 determines a harmonic segment using the pitch candidate value input from the pitch candidate value selector 102.

A harmonic-noise decomposition repetition unit 201 repeatedly interpolates and extrapolates a harmonic segment and a noise segment until the harmonic segment and the noise segment are correctly distinguished from each other. That is, the harmonic-noise decomposition repetition unit 201 amplifies a harmonic signal of the harmonic segment and attenuates a noise signal of the noise segment in the frequency domain.

After the harmonic signal of the harmonic segment is amplified and the noise signal of the noise segment is attenuated in the frequency domain of the input speech signal, a harmonic-noise decomposition determiner 202 determines whether an energy difference between two consecutive harmonic components is below a predetermined threshold. The harmonic-noise decomposition determiner 202 commands the harmonic-noise decomposition repetition unit 201 to amplify the harmonic signal of the harmonic segment and attenuate the noise signal of the noise segment, until it is determined that the energy difference between two consecutive harmonic components is below the predetermined threshold. When it is determined that the energy difference between two consecutive harmonic components is below the predetermined threshold, a harmonic-noise segment extractor 203 decomposes the harmonic segment and the noise segment distinguished by the amplification and attenuation.

Figure 2:
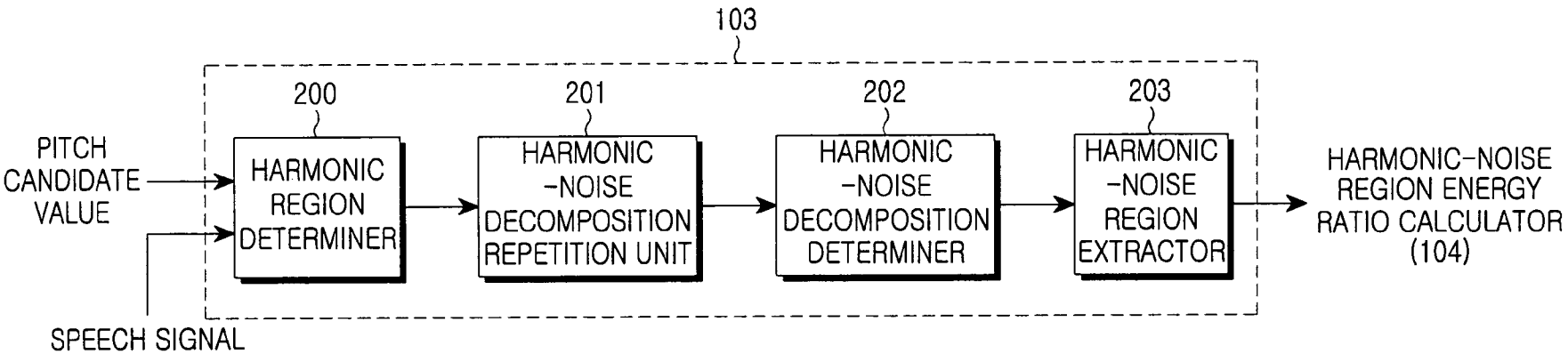
FIG. 2 is a block diagram illustrating the harmonic-noise region decomposer of FIG. 1, according to the present invention.

Although the harmonic-noise region decomposer 103 uses the decomposition method illustrated in FIG. 2 to decompose a harmonic region and a noise region, another decomposition method can be used if desired.

Signals of the harmonic region and the noise region decomposed by the harmonic-noise region decomposer 103 are illustrated in FIGS. 4B and 4C.

The harmonic-noise region energy ratio calculator 104 calculates an energy ratio of the harmonic-noise region. A harmonic to noise ratio (HNR) can be defined as a ratio of a harmonic signal region to a noise signal region. The HNR can be obtained using Equation (1).

$$HNR = 10\log_{10}\left(\sum_k |H(\omega_k)|^2 \Big/ \sum_k |N(\omega_k)|^2\right) \tag{1}$$

In Equation (1), "H" and "N" indicate a harmonic part and a noise part of the harmonic-noise region. In particular, "H" is defined as the harmonic part decomposed in the frequency domain and "N" is defined as the region other than the harmonic region decomposed in the frequency domain. "ω" indicates a value of frequency, and "k" indicates a number of a sample.

In general, a residual signal of a speech signal is a signal remaining by excluding a harmonic segment from the speech signal. According to the present invention, the residual signal is considered as a noise segment. Thus, an HNR and an HRR (Harmonic to Residual Ratio) are obtained using calculation methods having the same concept. The HRR can be obtained using Equation (3) based on Equation (2) indicating a harmonic model.

$$S_N = a_0 + \sum_{k=1}^{N} (a_k \cos n\omega_0 k + b_k \sin n\omega_0 k) + r_N, \quad n = 0, 1, \ldots, N-1 \equiv h_N + r_N \tag{2}$$

$$HRR = 10\log_{10}\left(\sum_k |H(\omega_k)|^2 \Big/ \sum_k |R(\omega_k)|^2\right) \tag{3}$$

In Equation (3), "H" and "R" are signals in the frequency domain derived from Equation (2). "H" is a union region of a sinusoidal representation region in the frequency domain and "R" is the other region (herein R is defined as residual signal, and is different from the noise region signal mathematically) except for the sinusoidal representation region in the frequency domain. "ω" indicates the value of frequency, and "k" indicates a number of the sample.

However, while the residual signal is used in a point of view of a sinusoidal representation in the HRR defined in Equation 3, the noise signal region is calculated after decomposing the harmonic-noise region.

A mixed voicing signal in a single frame of a general speech signal, in which a voiced segment and an unvoiced segment are mixed, shows a periodic structure in a low frequency band but becomes unvoiced in a high frequency band, showing a characteristic similar to noise. Thus, the HNR can be obtained by decomposing the harmonic-noise region after a low pass filtering process.

To remove a problem which may occur when a large energy difference between frequency bands exists in a speech signal frame, e.g., when an unvoiced segment having a too large HNR affected due to a high energy band exists, and perform a correct control of each band, a ratio of harmonic-noise regions can be calculated using a sub-band HNR (SB-HNR).

The SB-HNR is used to calculate a ratio of total harmonic-noise regions, is obtained by calculating an HNR of each harmonic region and summing the calculated HNRs, and effectively normalizes each harmonic region with respect to other sub-band frequency regions having a relatively weak harmonic feature. The SB-HNR can be obtained using Equation (4).

$$SB-HNR = 10\sum_{n=1}^{N} \log_{10}\left[\frac{\sum_{\omega=\Omega_n^-}^{\Omega_n^+} |H(\omega)|^2}{\sum_{\omega=\Omega_n^-}^{\Omega_n^+} |N(\omega)|^2}\right] \tag{4}$$

Here, $\Omega_n^+$ denotes an $N^{th}$ upper frequency bound of a harmonic band, $\Omega_n^-$ denotes an $N^{th}$ lower frequency bound of the harmonic band, and N denotes the number of sub-bands.

The SB-HNR can be represented as Equation (5).

$$SB\text{-}HNR = \Sigma(\text{Blue Area(per Harmonic Band)/Red Area (per Harmonic Band)}) \tag{5}$$

Figure 4:
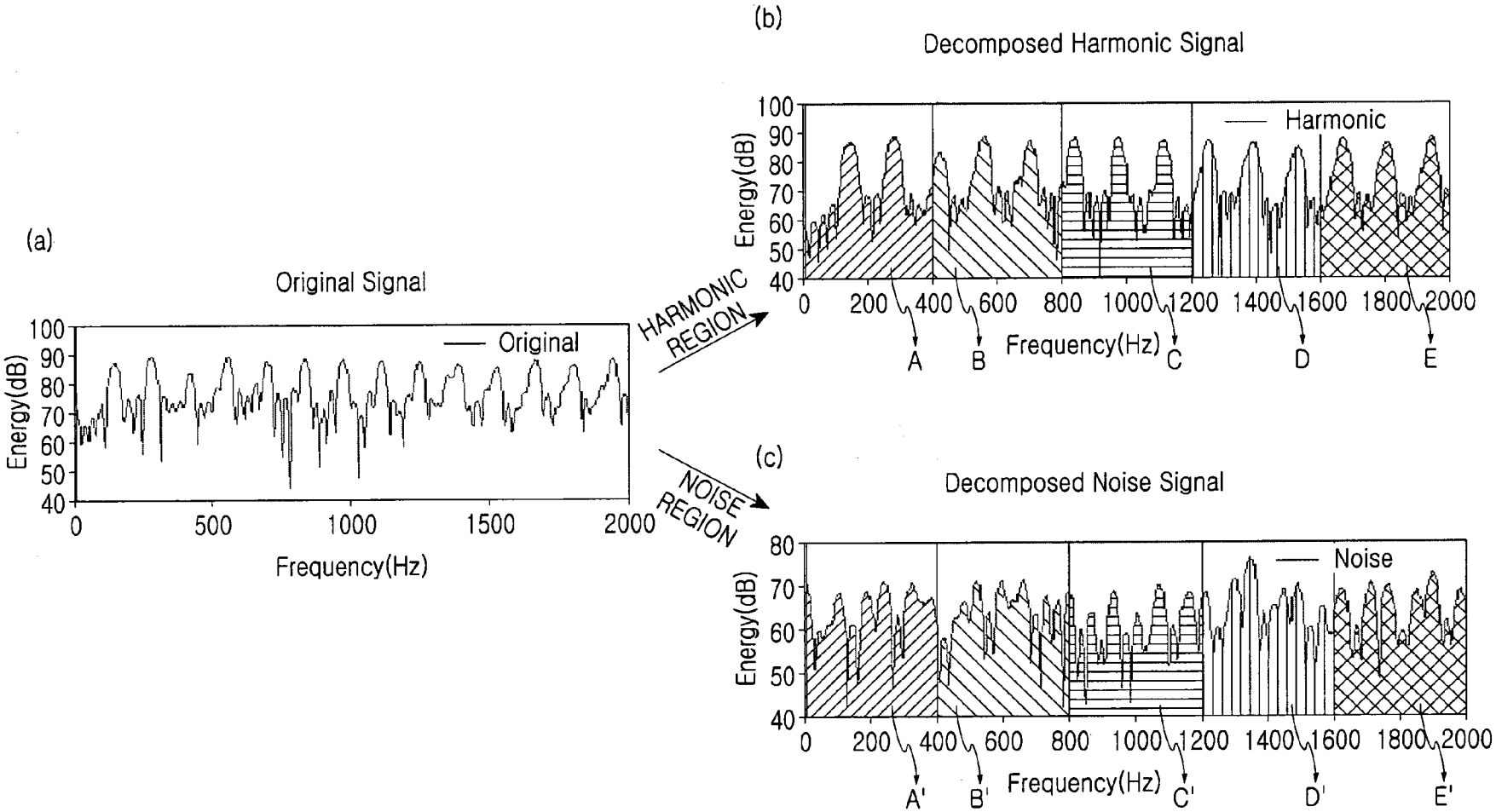
FIG. 4 are graphs illustrating of a signal of a harmonic region and a signal of a noise region, which are decomposed from a general speech signal, according to the present invention.

If it is assumed that FIG. 4(A) is a waveform of a frequency domain signal of an original speech signal, FIG. 4(B) indicates 'Blue Area', i.e., harmonic regions after harmonic-noise decomposition, and FIG. 4(C) indicates 'Red Area', i.e., noise regions after the harmonic-noise decomposition. A single sub-band is a band having a center at a harmonic peak and having a bandwidth of half a pitch in both sides of the center. For example, if FIG. 4 is referred to, the SB-HNR is defined as Equation (6).

$$SB\text{-}HNR = A/A' + B/B' + C/C' + D/D' + E/E' \tag{6}$$

As described above, in the SB-HNR as compared to the HNR, each harmonic region is effectively equalized, and thus, every harmonic region has a similar weight. In addition, since HNRs of each sub-band are separately calculated, the SB-HNR can be used as an ideal method for performing sub-band Voiced/UnVoiced (V/UV) classification to define a voiced segment and an unvoiced segment of each frequency band.

After decomposing the harmonic-noise region, the energy ratio of the harmonic-noise region is obtained using Equation (7).

$$HNER = \frac{\sum_\omega |H(\omega)|^2}{\sum_\omega |N(\omega)|^2} \tag{7}$$

In Equation (7), "H" and "N" represent a harmonic part and a noise part of the frequency region signal after the harmonic-noise decomposition using each pitch candidate value, and "ω" indicates the value of the frequency. Noise regions indicate the residual signal region except for the harmonic regions in the signal after the harmonic-noise decomposition.

As described above, the harmonic-noise region energy ratio calculator 104 calculates HNERs of the harmonic-noise regions decomposed using the pitch candidate values. The calculated HNERs are input to the pitch information selector 105, and the pitch information selector 105 selects the maximum value out of the calculated HNERs as a pitch value of the input speech signal frame.

Figure 3:
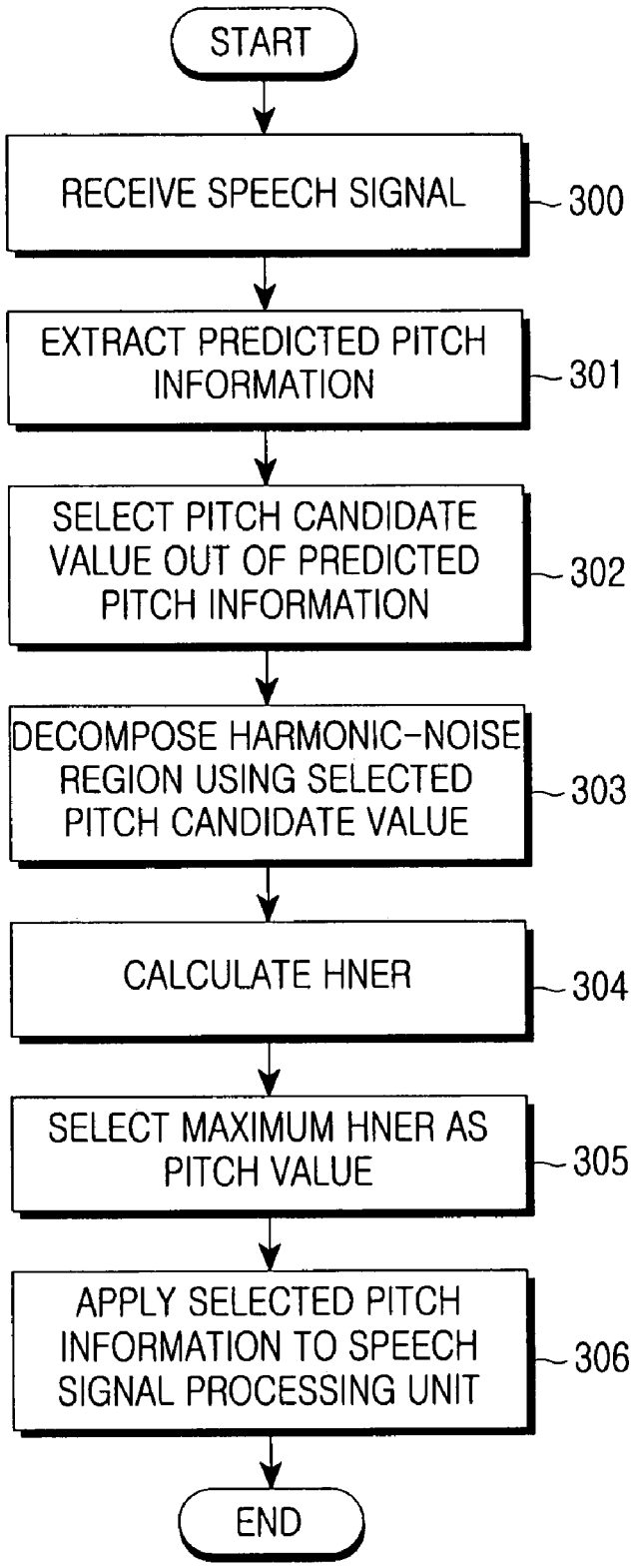
FIG. 3 is a flowchart illustrating a method of extracting optimum pitch information from a speech signal according to the present invention.

A process of extracting pitch information from an input speech signal in the pitch information extracting apparatus 100 will now be described with reference to FIG. 3, which is a flowchart illustrating a method of extracting optimum pitch information from a speech signal according to the present invention.

When a speech signal is input in step 300, the pitch information extracting apparatus 100 extracts predicted pitch information from a frame of the input speech signal using the pitch detection algorithm in step 301. Herein, it is assumed that the input speech signal is a speech signal converted to the frequency domain.

The pitch information extracting apparatus 100 selects a pitch candidate value by selecting a predicted pitch value corresponding to a pre-set range among pitch values predicted in the speech signal frame in step 302. Herein, the range pre-set to select the pitch candidate value can be determined according to the performance of a system.

The pitch information extracting apparatus 100 decomposes a harmonic-noise region by determining a harmonic segment using the selected pitch candidate value in step 303. Herein, the pitch information extracting apparatus 100 decomposes harmonic-noise regions using each of the pitch candidate values. That is, harmonic-noise regions corresponding to the number of the pitch candidate values are decomposed.

The pitch information extracting apparatus 100 calculates HNERs in step 304. That is, HNERs of all harmonic-noise regions decomposed using the pitch candidate values are calculated. Herein, a method of calculating the HNERs of the harmonic-noise regions corresponds to an operation of the harmonic-noise region energy ratio calculator 104 illustrated in FIG. 1.

The pitch information extracting apparatus 100 selects the maximum value out of the HNERs calculated in step 304 as a pitch value of the input speech signal frame in step 305. The pitch information extracting apparatus 100 outputs the selected pitch information to a speech signal processing unit 110 illustrated in FIG. 1 so that the selected pitch information can be used when the speech signal frame is processed.

As described above, according to the present invention, by extracting harmonic peaks, which are always output higher than a noise power, using HNER calculation through harmonic-noise decomposition, an apparatus and method for extracting pitch information from a speech signal is robust to noise, and the amount of calculation is significantly reduced by comparing a current value to a previous or subsequent value and simply extracting only peak information, thereby obtaining a fast calculation speed. In addition, by using only harmonic peaks in an audio signal without any assumption for the audio signal, pitch information requisite in the audio signal can be easily obtained, and an accuracy of pitch information extraction can be increased. In addition, since pitch information can be correctly and quickly extracted, a speech signal can be correctly and quickly processed in speech coding, recognition, synthesis, and robustness. In particular, the apparatus and method for extracting pitch information from a speech signal may be used in mobile devices having limited computation power and/or memory availability, such as cellular phones, telematics, personal digital assistants (PDAs) or MP3s, or in devices that require quick speech processing.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. An apparatus for extracting pitch information from a speech signal, the apparatus comprising:

a pilot pitch detector for extracting predicted pitch information from a frame of an input speech signal;

a pitch candidate value selector for selecting one or more pitch candidate values from the predicted pitch information according to a predetermined condition;

a harmonic-noise region decomposer for distinguishing a harmonic region from a noise region through amplification of the harmonic region and attenuation of the noise region in a frequency domain, and decomposing the harmonic region and the noise region using each of the selected pitch candidate values when the harmonic region has been amplified and the noise region has been attenuated such that an energy difference between two consecutive harmonic regions is below a threshold;

a harmonic-noise energy ratio calculator for calculating an energy ratio of the decomposed harmonic region to each of the decomposed harmonic noise regions; and a pitch information selector for selecting a pitch candidate value of a harmonic-noise region in which maximum value among the calculated harmonic-noise energy ratio exists as a pitch value of the input frame of the speech signal.

2. The apparatus of claim 1, wherein the input speech signal is a speech signal obtained by converting a speech signal of a time domain to a speech signal of a frequency domain.

3. The apparatus of claim 1, wherein the pilot pitch detector extracts the predicted pitch information from the input speech signal frame using a pitch detection algorithm.

4. The apparatus of claim 1, wherein the harmonic-noise energy ratio calculator calculates a harmonic-noise energy ratio (HNER) using the equation below $$HNER = \frac{\sum_{\omega} |H(\omega)|^2}{\sum_{\omega} |N(\omega)|^2},$$

where HNER denotes an energy ratio of a harmonic region to a noise region, $$\sum_{\omega} |N(\omega)|^2$$

denotes an energy value of the harmonic region, and $$\sum_{\omega} |H(\omega)|^2$$

denotes an energy value of the noise region, and "107 " is a frequency value.

5. The apparatus of claim 1, wherein the harmonic-noise energy ratio calculator calculates a sub-band harmonic-noise ratio (SB-HNR) using the equation below by dividing a harmonic region into N sub-bands $$SB-HNR = 10\sum_{n=1}^{N} \log_{10}\left[\frac{\sum_{\omega=\Omega_n^-}^{\Omega_n^+} |H(\omega)|^2}{\sum_{\omega=\Omega_n^-}^{\Omega_n^+} |N(\omega)|^2}\right],$$

where, $\Omega_n^-$ denotes an $N^{th}$ upper frequency bound of a harmonic band, $\Omega_n^-$ denotes an $N^{th}$ lower frequency bound of the harmonic band, and N denotes the number of sub-bands.

6. The apparatus of claim 5, wherein a single sub-band is a band having a center at a harmonic peak and having a bandwidth of half a pitch in both sides of the center.

7. A method of extracting pitch information from a speech signal, the method comprising the steps of:

extracting predicted pitch information from a frame of an input speech signal using a speech processing system;

selecting one or more pitch candidate values from the predicted pitch information according to a predetermined condition;

distinguishing a harmonic region from a noise region through amplification of the harmonic region and attenuation of the noise region in a frequency domain decomposing the harmonic region and the noise region using each of the selected pitch candidate values when the harmonic region has been amplified and the noise region has been attenuated such that an energy difference between two consecutive harmonic regions is below a threshold;

calculating an energy ratio of each of the decomposed harmonic regions to each of decomposed noise regions; and selecting a pitch candidate value of a harmonic-noise region in which maximum value among the calculated harmonic-noise energy ratio exists as a pitch value of the input frame of the speech signal.

8. The method of claim 7, wherein the input speech signal is a speech signal obtained by converting a speech signal of a time domain to a speech signal of a frequency domain.

9. The method of claim 7, wherein the step of extracting predicted pitch information comprises extracting the predicted pitch information from the input speech signal frame using a pitch detection algorithm.

10. The method of claim 7, wherein the step of calculating the energy ratio comprises calculating a harmonic-noise energy ratio (HNER) using the equation below $$HNER = \frac{\sum_{\omega} |H(\omega)|^2}{\sum_{\omega} |N(\omega)|^2},$$

where HNER denotes an energy ratio of a harmonic region to a noise region, $$\sum_{\omega} |H(\omega)|^2$$

denotes an energy value of the harmonic region, and $$\sum_{\omega} |N(\omega)|^2$$

denotes an energy value of the noise region.

11. The method of claim 7, wherein the step of calculating the energy ratio comprises calculating a sub-band harmonic-noise ratio (SB-HNR) using the equation below $$SB-HNR = 10\sum_{n=1}^{N} \log_{10}\left[\frac{\sum_{\omega=\Omega_n^-}^{\Omega_n^+} |H(\omega)|^2}{\sum_{\omega=\Omega_n^-}^{\Omega_n^+} |N(\omega)|^2}\right],$$

where, $\Omega_n^-$ denotes an $N^{th}$ upper frequency bound of a harmonic band, $\Omega_n^-$ denotes an $N^{th}$ lower frequency bound of the harmonic band, and N denotes the number of sub-bands.

12. The method of claim 11, wherein a single sub-band is a band having a center at a harmonic peak and having a bandwidth of half a pitch in both sides of the center.

* * * * *